US006013015A

United States Patent [19]

Newman et al.

[11] Patent Number: 6,013,015

[45] Date of Patent: Jan. 11, 2000

[54] EXERCISE DEVICE

[76] Inventors: Geraldine Newman, 315 E. 72nd St., Apt. 5K; Catherine McWilliams, 201 E. 69th, Suite 2C, both of New York, N.Y. 10021

[21] Appl. No.: 09/002,176

[22] Filed: Dec. 31, 1997

Related U.S. Application Data

[62] Division of application No. 08/625,648, Mar. 29, 1996, Pat. No. 5,713,822, which is a division of application No. 08/574,814, Dec. 19, 1995, Pat. No. 5,626,545, which is a continuation-in-part of application No. 08/222,681, Apr. 4, 1994, abandoned, which is a continuation-in-part of application No. 08/070,907, Jun. 4, 1993, abandoned.

[51] Int. Cl.[7] ..... A63B 21/02

[52] U.S. Cl. ..... 482/126; 482/121; 482/122

[58] Field of Search ..... 482/121, 44, 126, 482/127, 122, 128

[56] References Cited

U.S. PATENT DOCUMENTS 2,806,699 9/1957 Spooner ..... 482/127

4,779,867 10/1988 Hinds ..... 482/126

5,713,822 2/1998 Newman et al. ..... 482/126

*Primary Examiner*—Jerome W. Donnelly

*Attorney, Agent, or Firm*—Howard C. Miskin

[57] ABSTRACT

A thigh and buttocks exercising device includes a pair of hook shaped or curved clamp members terminating in linear inner legs connected to respective knuckles of a torsion spring-loaded hinge to bias the clamp members to a contracted position with their free ends in relatively vertically offset overlapping positions. Each clamp member is formed of a rigid metal tube preferably covered by a soft plastic or elastomeric sheath. The biasing torsion spring may terminate in tangentially projecting hook shaped cores of the clamp members. In alternative constructions, the clamp members are biased by resilient devices, such as a flexible-compressible member, a compression spring, or an elastomeric cord adjustably extending between the free ends of the clamp members.

9 Claims, 6 Drawing Sheets

EXERCISE DEVICE

REFERENCE TO RELATED APPLICATIONS

The present application is a divisional application Ser. No. 08/625,648 Mar. 29, 1996, now U.S. Pat. No. 5,713,822 which is hereby incorporated by reference which in turn is a divisional of application Ser. No. 08/574,814 Dec. 19, 1995, now U.S. Pat. No. 5,626,545 which in turn is a continuation-in-part of U.S. patent application Ser. No. 08/222,681 filed Apr. 4, 1994 now abandoned, which, in turn, is a continuation-in-part of U.S. patent application Ser. No. 08/070,907 filed Jun. 4, 1993 now abandoned.

BACKGROUND OF THE INVENTION

The present invention relates generally to improvements in exercise devices and it relates particularly to improved devices for exercising the thighs and buttocks of a person.

Many types of devices and apparatus have been available or proposed for exercising the thighs and buttocks of a person but these have many shortcomings. They are either of no or limited effectiveness and often complex and expensive, bulky and space consuming, and generally unreliable, awkward and inconvenient to use and otherwise leave much to be desired.

The present invention provides a safe, non-stressful exercise tool for the lower back, gluteus maximus, medius and minimus and thighs—inner and outer and front (quadriceps) and backs (hamstrings).

There is a need to exercise this part of the body and most exercises that do it may be stressful to other joints and muscles. Also equipment to exercise this part of the body has been large and expensive.

The human body is designed with muscles wrapping around and joints moving in a ball and socket mode.

Exercise machines are tools to get the body to react. How the body reacts is controlled by what the body is required to do. The body responds to the position it is placed in and then how it is moved from there.

The present invention is ergononmically designed to fit the body in such a way that when the user presses against it, it automatically isolates and exercises the gluteus maximus, medius and minimus as well as the abductors and adductors with one movement. The mat places the user in the correct position to isolate the correct muscles. The method is isolation and resistance. The invention allows one to perform the exercises while standing so there is no compression of the spine which can be caused by seated exercise.

The benefits are improved strength, flexibility, agility, muscle tone and muscle control, with an exercise tool that is lightweight, portable, versatile, and easy to use by a large variety of people. The size makes it easy for people to travel with it or fit in a fitness break at work.

SUMMARY OF THE INVENTION

It is a principal object of the present invention to provide an improved exercising device.

Another object of the present invention is to provide an improved device for exercising the thighs and buttocks of a person.

Still another object of the present invention is to provide an improved compact and reliable thigh and buttocks exercising device.

A further object of the present invention is to provide a device of the above nature characterized by its ruggedness, simplicity in construction and use, its low cost, its convenience and effectiveness, and its high versatility and adaptability.

The above and other objects of the present invention will become apparent from a reading of the following description taken in conjunction with the accompanying drawing which illustrates preferred embodiments thereof.

An exercising device in accordance with the present invention includes a pair of hook thigh engaging clamp members which are movable toward and from each other and means biasing the clamp members toward each other with increasing force with the separation of the clamp members.

In one form of the improved exercising device, each clamp member is tubular and includes an outer thigh engaging curved hook section and an inner linear leg, the concave faces of the hock sections being mutually confronting. The clamp member tubes are formed preferably of metal and covered with soft plastic or elastomeric sheaths. The outer ends of the clamp legs are coupled to respective knuckles of a hinge, the knuckles housing a helical torsion spring terminating in radially projecting opposite legs which bear on respective knuckles to bias them in a direction urging the clamp members to a closed position with end portions thereof overlapping.

In another embodiment of the present invention a helical torsion spring terminates in tangentially extending hook shaped legs, the spring being housed in complementary shells mounted on the legs to enclose the spring. The hook shaped legs are each covered by an elastomeric sponge sheath. Alternatively the legs are hollow and rigid and sheathed in resilient sponge and hinged at their inner ends and an elastomeric cord extends through the legs, and about the hinge, their free ends projecting through the free ends of the legs and being adjustably joined by a coupling member.

In an alternative structure a pair of spaced flexible resilient sponge tubes are slidably mounted on an elastomeric cord whose free end portions are adjustably coupled. A mat member is disclosed having representations of foot soles in selected positions to instruct the use of the improved exercise device.

The improved exercising devices are simple and rugged, are highly reliable and maintained in a comfortable pre-applied position on the person, are effective, and easy and convenient to use.

DESCRIPTION OF THE PREFERRED EMBODIMENTS

Figure 1:
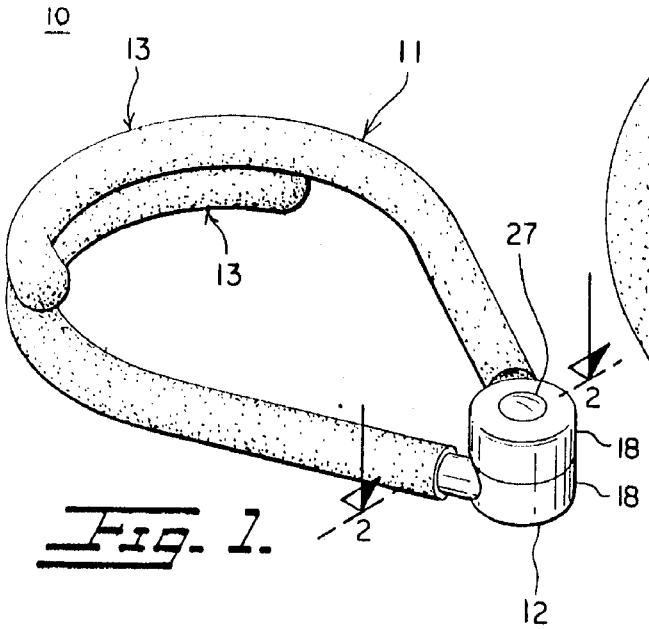
FIG. 1 is a perspective view of a preferred embodiment of the present invention.
Figure 2:
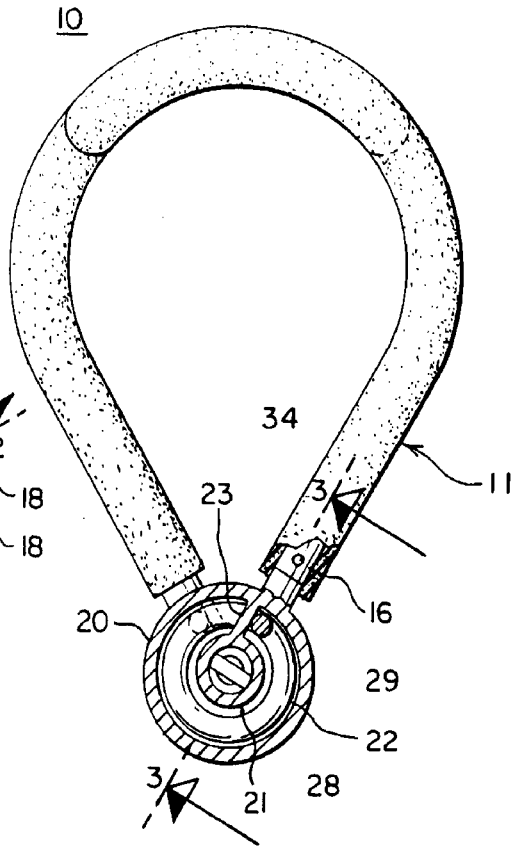
FIG. 2 is a partially fragmented top plan view of the embodiment of FIG. 1.
Figure 3:
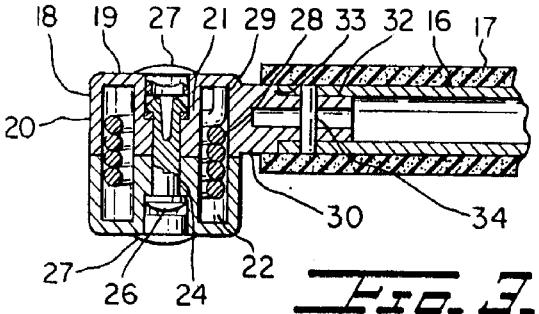
FIG. 3 is a sectional view taken along line 3—3 in FIG. 2.

Referring now to the drawings, particularly FIGS. 1 to 5 thereof which illustrate an embodiment of the present invention, the reference numeral 10 generally designates the improved exercise device shown as being applied to the thighs T of an exercising person employing device 10. The exercise device 10 includes a pair of thigh engageable hook or clamp members 11 swingably joined at their inner ends by a spring-loaded hinge member 12 loaded to resilient urge hook members 11 to a contracted condition, as shown in FIGS. 1 and 2.

Each of the hook members 11 includes an outer curved hook section 13 terminating at its inner end in a longitudinally extending linear leg 14. Each hook member 11 is formed of a rigid metal tubular core section 16 open at its inner end and closed and rounded at its outer end (as viewed in FIGS. 1–5) and covered by a thick soft plastic or elastomeric sheath 17, the sheath 17 extending beyond the inner end of core member 16.

Hinge member 12 includes a pair of coaxial cylindrical knuckles 18 closed at thier outer ends by annular walls 19 and provided with coaxial end-to-end skirt walls 20 whose end edges are in mutual slidable engagement. Projecting inwardly from the inner periphery of each annular wall 19 is an axial tubular section 21 which delineates with skirt walls 20 an axially extending annular cavity 22, the confronting outer and inside faces of each respective pair of skirt wall 20 and tabulate wall 22 being connected by a stop defining short radial wall 23 joining a respective annular end wall 19. Outwardly, facing peripheral shoulders are formed on the inside peripheral faces of tubular sections 21 and the axial bore delineated by tubular wall 21 is rotatably engaged by a hinge pin 24 having enlarged end heads 26 bearing on the aforesaid peripheral shoulders to releasably and rotatably interlock knuckles 18. The open outer ends of tubular walls 22 are closed by respective plugs 27.

Housed in the annular cavity 22 and coaxial with an encircling tubular walls 21 is a helical torsion spring 28 terminating at opposite ends in radially offset longitudinally projecting end legs 29.

Each of the skirt walls 20 has integrally formed therewith an outwardly radially projecting cylindrical coupling arm 30 having a coaxial outer section 32 of reduced cross section delineated from the arm inner section 33 by an annular shoulder. Arm outer section 32 telescopes the outer end of clamp member tubular core section 16 and is secured therein by a diametric pin 34 engaging diametrically aligned openings in tubular core section 16 and coupling arm outer section 32, the end of leg 16 abutting the aforesaid annular shoulder.

The torsion spring 28 is so oriented and stressed that, in the unused condition of exercise device 10, it biases the exercise device to a closed contracted condition with the free ends of hook section 13 overlapping and being axially relatively offset. The opening circumscribed by the clamp members 11 is generally pear or light bulb shaped when the clamp members 11 are in closed contracted position, and generally heart shaped when clamp members 11 are in opening operating position, as shown in FIG. 5.

Figure 4:
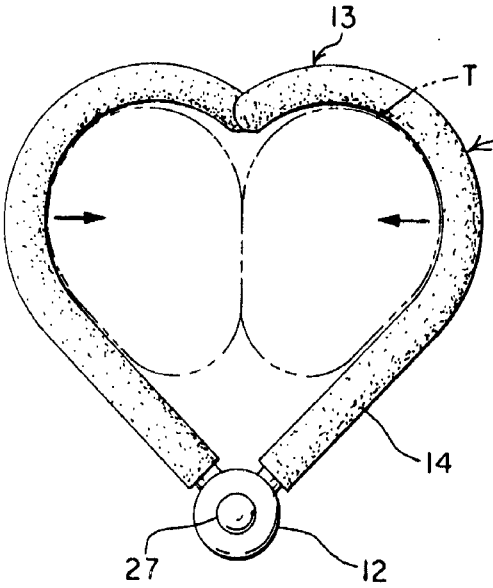
FIG. 4 is a top plan view of the embodiment of FIGS. 1–3 in a contracted condition and as being applied to the thighs of a user.
Figure 5:
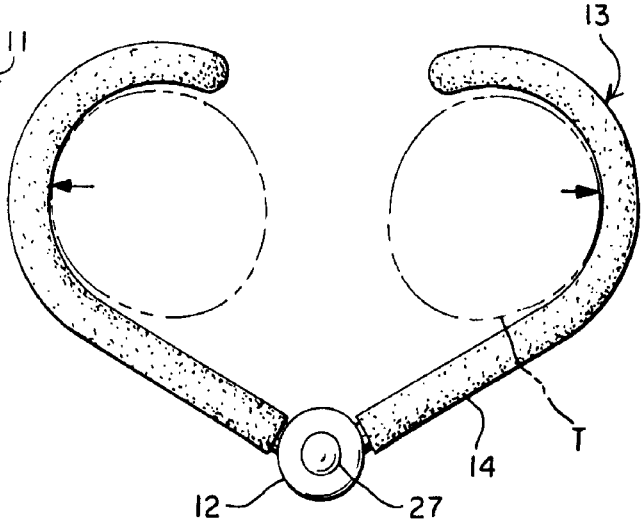
FIG. 5 is a view similar to FIG. 4 showing the device expanded to its open condition by the user's thighs.

In the application and operation of exercise device 10, the clamp members 11 are rotatably separated about hinge 12 against the influence of torsion spring 28 to an open position, as shown in FIG. 5 and slid forwardly over the thighs T in their contracted condition and then released to permit the clamp members 11 to contract and tightly engage the opposite outer faces of thighs T and urge them together as shown in FIG. 4. The thighs T are then spread against the contraction influence of hook sections 13 which increases in its contraction pressure with the separation thereof and the increased loading of torsion spring 28. The exercise is continued by the successive spreading and contraction of thighs T against the contraction influence of the clamp members 11 to exercise the thighs T and buttocks in an optimum manner.

Although exercise device 10 is illustrated as being applied to a person's thighs, it may be used to exercise other parts of the body.

Figure 6:
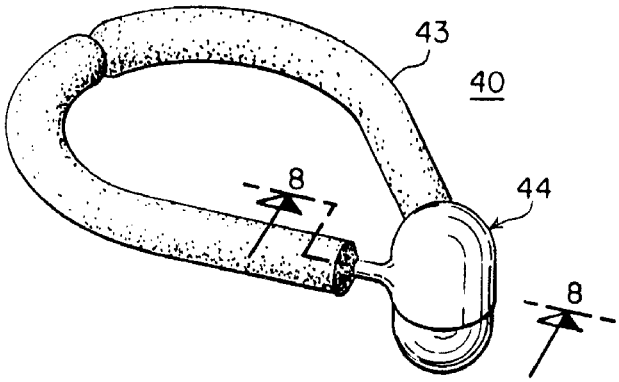
FIG. 6 is a perspective view of another embodiment of the present invention.
Figure 7:
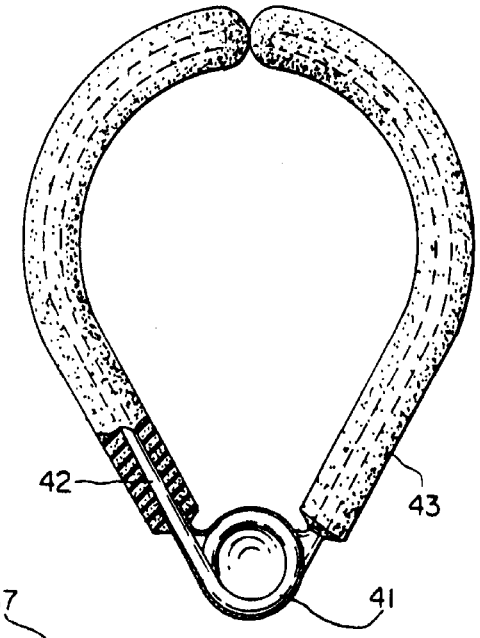
FIG. 7 is a top plan view of the embodiment of FIG. 6 partially broken away.
Figure 8:
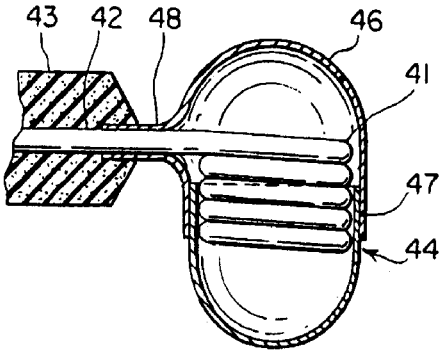
FIG. 8 is an enlarged sectional view taken alone line 8—8 in FIG. 6.

Another embodiment of the present invention is illustrated in FIGS. 6–8 of the drawings in which the exercise device is generally designated by reference numeral 40 and includes a helical wire torsion spring 41 with the opposite ends thereof having integrally formed hook member defining curved thigh engaging clamp arms 42. Each of arms 42 extends tangentially from opposite ends of spring 41 respectively converging outwardly and each lies in an axially spaced plane which are approximately parallel spring 41. The faces of arms 42 are concave and confront each other. Each face of arms 42 is preferably covered by a soft resilient compressible elastomeric sponge sheath 43. The spring 41 swingably supports the arms 42 and bias the arms 42 to a contracted condition with the closed ends of sheaths 43 in mutual contact. The opening circumscribed by clamp arms 42 in closed contracted position is generally egg shaped, with the smaller end facing the helical spring 41.

The spring 41 is enclosed in a protective housing 44 which is formed of opposing cup shaped shells 46 having open end binders 47. The binders of one shell 46 being of slightly less diameter than and telescoping that of the other shell 46. Each shell 46 is provided with a radially, outwardly projecting sleeve 48 which firmly engages the inner end of a respective arm 42.

The application and operation of the improved exercise device 40 are similar to that of exercise device 10 earlier explained.

Figure 9:
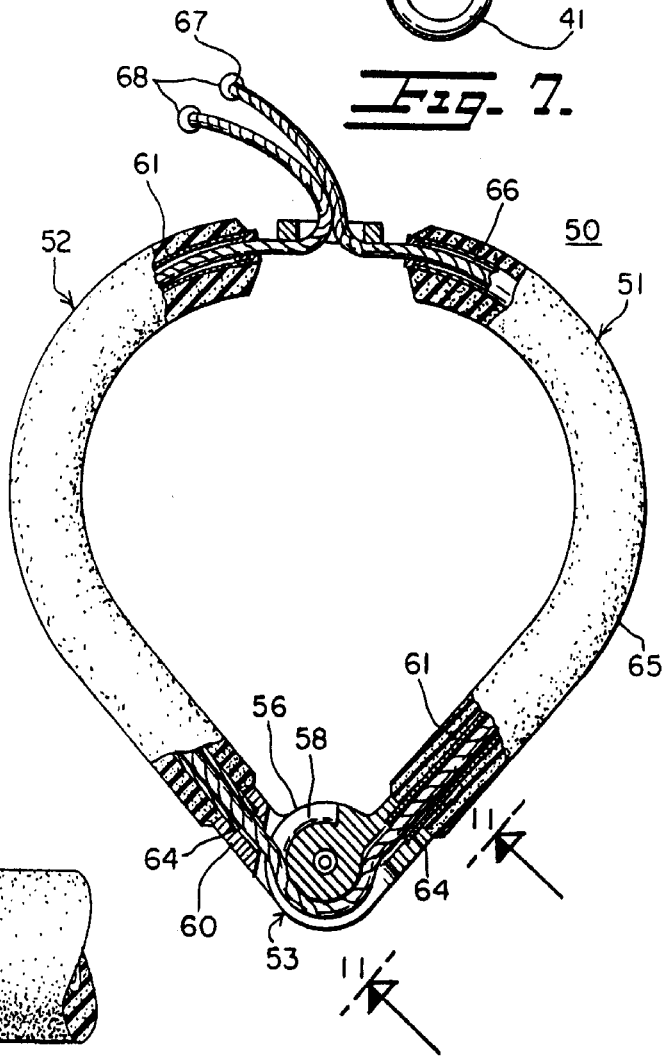
FIG. 9 is a partially fragmented plan view of a further embodiment of the present invention.
Figure 10:
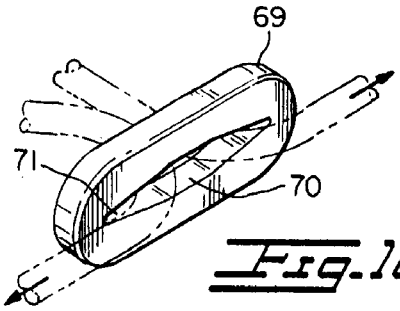
FIG. 10 is a perspective view of a portion of the exercising device shown in FIG. 9.
Figure 11:
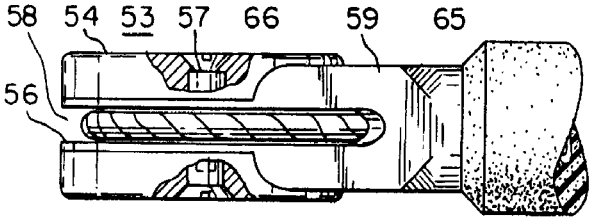
FIG. 11 is an enlarged sectional view taken along line 11—11 of FIG. 9.

Referring now to FIG. 9–11 of the drawings which illustrate another embodiment of the present invention which differs from those earlier described primarily in that the clamp arms are biased to their closed condition by an elastomeric cord instead of a helical torsion spring. Specifically the modified exercising device 50 of FIGS. 9–11 includes a pair of thigh engaging rigid tubular hook shaped clamp members 51 and 52 supported for swinging in a common or parallel planes by a hinge member 53. The clamp members 51 and 52 have confronting concave faces and are relatively swingable between a contracted condition with their free ends proximately spaced and an expanded condition with their free ends increasingly separated.

Hinge member 53 includes a pair of axially spaced integrally joined outer circular discs 54 rotatably sandwiching an inner disc 56, discs 54 and 56 being rotatably joined by a pivot pin 57, a peripheral guide groove 58 is formed in the face periphery of disc 56. A socket member 59 extends radially from and is integrally formed with inner disc 56 and a socket member 60 is integrally formed with and projects radially from pair of discs 54 and 56, the socket members having outwardly facing openings.

Each of the clamp arms 51 and 52 includes a rigid tubular plastic lined metal core 61 having an internal plastic lining 63 terminating at its outer end in an annular lip 64 overlying the outer end of each metal core 61. The inner end of each metal core 61 telescopes and is firmly secured in a respective socket member 59, 60. A soft compressible sponge sheath 65, formed of natural or synthetic rubber, covers each of the tubular metal cores 61. An elastomeric cord 66 preferably including a core of natural or synthetic rubber covered by a braided fibrous tubular sheath. The elastomeric cord 66 transverses the clamp arm tubular cores and its medial portion extends along the peripheral groove 58. The outer ends 67 of cord 66 project beyond the free ends of clamp arms 51, 52 and terminate in knobs 68. A loop shaped coupling member 69 has a longitudinally extending opening 70 with longitudinally converging confronting end faces delineating wedge shaped slots 71.

The free outer ends 67 of cord 66 are releasably and firmly engaged in respective wedge slots 71 to permit the adjustment of the length of the elastomeric cord 66 extending between clamp arms 51 and 52. While metal cores were described, a hard rigid plastic shell can also be used.

The operation and application of exercise device 50 are similar to those of the earlier embodiments, elastomeric cord 66 functioning to bias the clump arms 51 and 52 to their contracted condition and releasably coupling member 69 permitting the adjustment of such bias and the release of the ends of the cords to facilitate the application of the device 50 to the thighs of a user.

Figure 12:
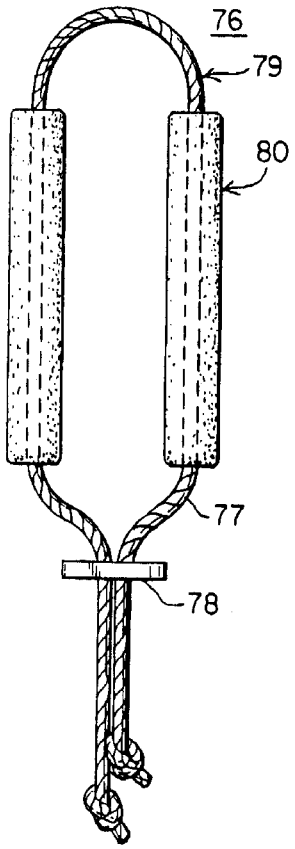
FIG. 12 is a top plan view of another embodiment of the present invention shown in an unstressed contracted condition.
Figure 13:
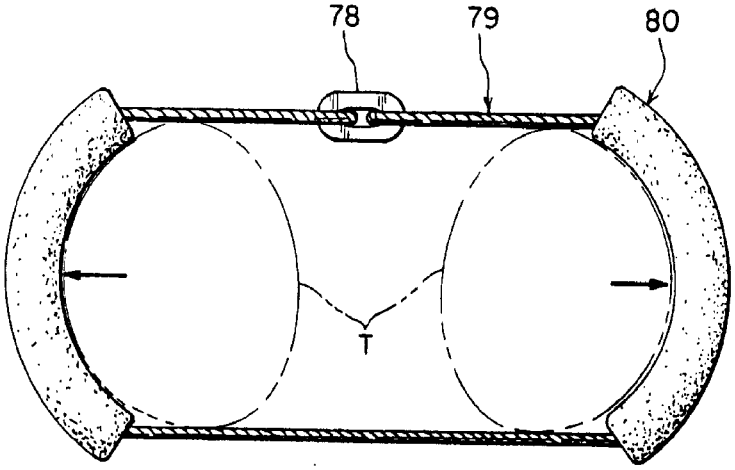
FIG. 13 is a plan view of the embodiment of FIG. 12 shown in a stressed expanded condition and as being applied to a user's thighs.
Figure 14:
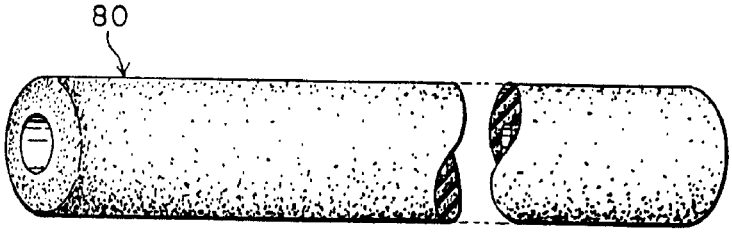
FIG. 14 is a foreshortened perspective view of a portion of the exercising device shown in FIG. 12.

Referring now to FIGS. 12–14 which illustrate another of the improved device 76, the modified exercise device 76 includes an elastomeric cord 77 of the structure of cord 66 described earlier and a coupling member 78 similar to coupling member 69 releasably and firmly engaging the opposite tails or end sections of cord 77 to form cord 77 into a loop 79. Slidably engaging each opposite side of loop 79 is an elongate tubular cushion member 80 formed of an elastomeric compressible sponge material, such as an expanded or foamed elastomeric plastic.

In using the device 76 the end sections of cord 77 is released by coupling member 78 which is retracted to the knots formed at the ends of cord 77 to fully expand the loop 79. The device is then slid over the contracted thighs of the user and the coupling member 78 is advanced to tighten loop 79 and the ends of the looped are then wedge engaged by coupling member 78.

Figure 15:
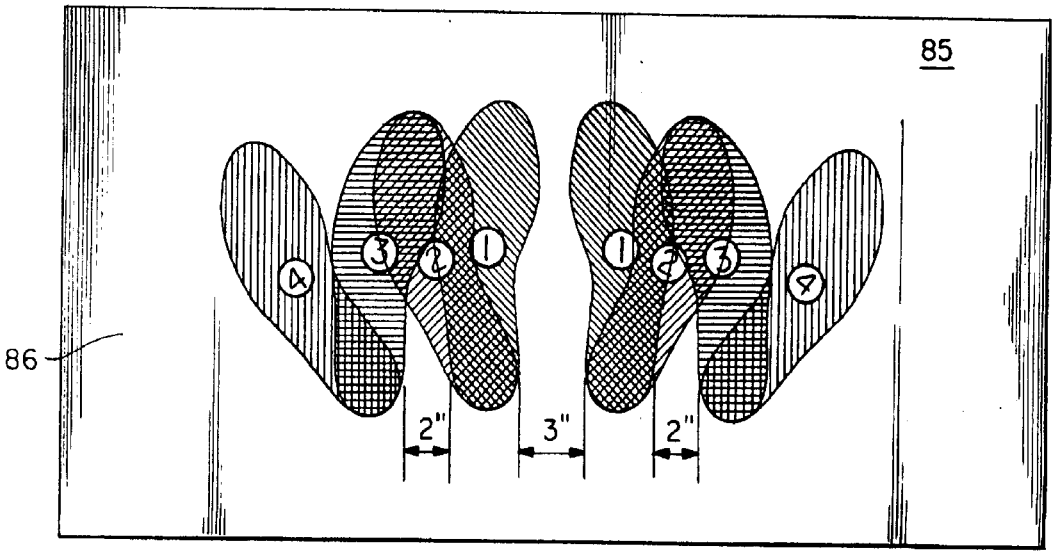
FIG. 15 is a top plan view of a foot position indicating mat employed with any of the embodiments of the present invention.

A foot positioning mat 85 as shown in FIG. 15 may be used with any of the exercise devices described herein. The mat 85 has imprinted on its exposed or top face 86, the representations of the left and right foot soles of a user shown in different positions attendant to the exercise procedure. The represented pair of left and right soles of the user or exerciser is shown in a contracted condition, for example with the heels spaced apart 3 inches and in a spread condition with the distance between the heel representations in the contracted and spread condition being for example, 2 inches. Additionally, the feet may be turned about the respective heels between forwardly directed positions and outwardly turned positions. The changes in the spacing between the feet and their turn angles are effected while under the influence of any exercise device of the present invention having additional embodiments shown in FIGS. 16–20.

Figure 16:
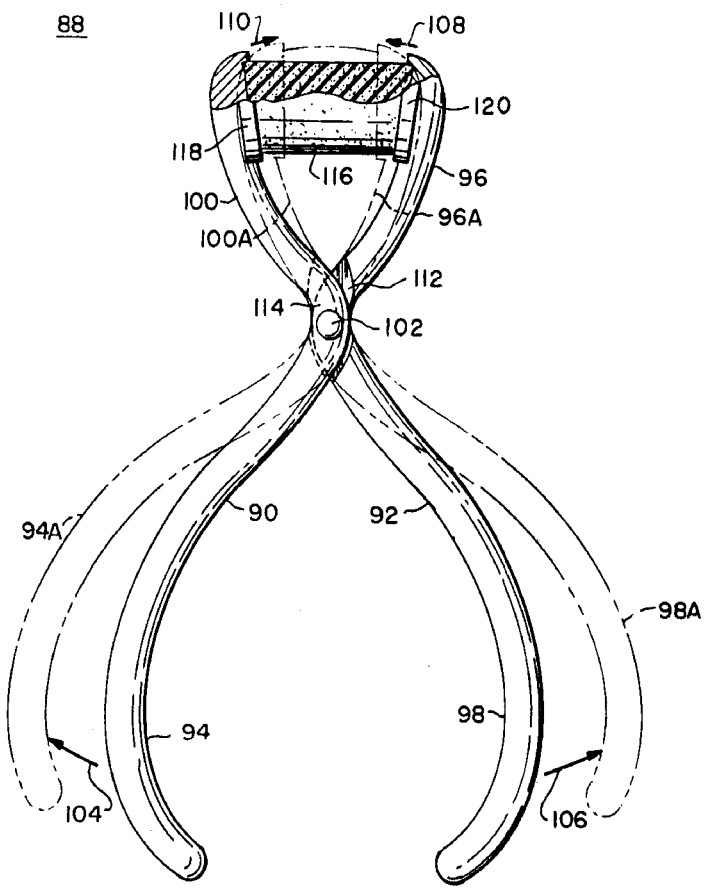
FIG. 16 is a perspective view of another embodiment of the present invention that employs an elastomeric member at one of its ends to create resistance for exercising purposes.
Figure 18:
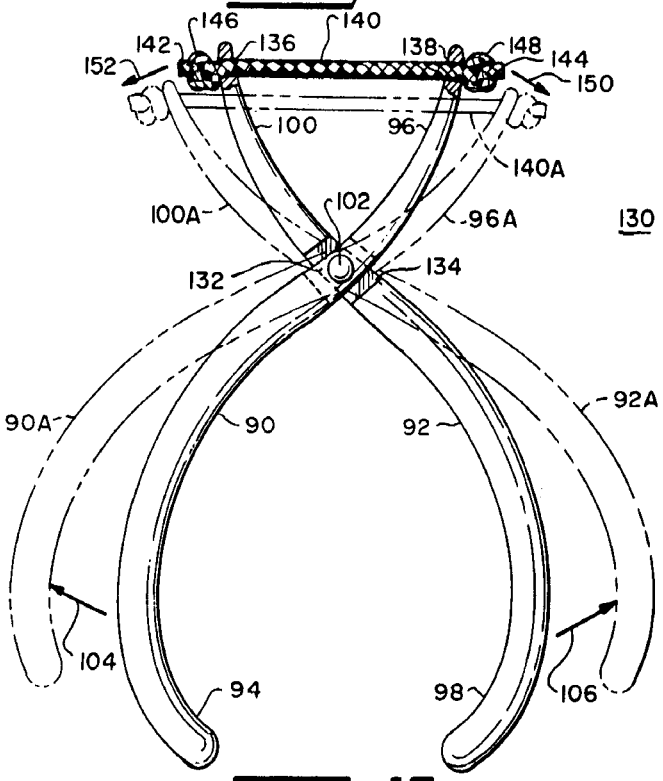
FIG. 18 is a perspective view of yet another embodiment of the present invention that employs an elastomeric cord at one of its ends of its thigh contacting clamp members.
Figure 17:
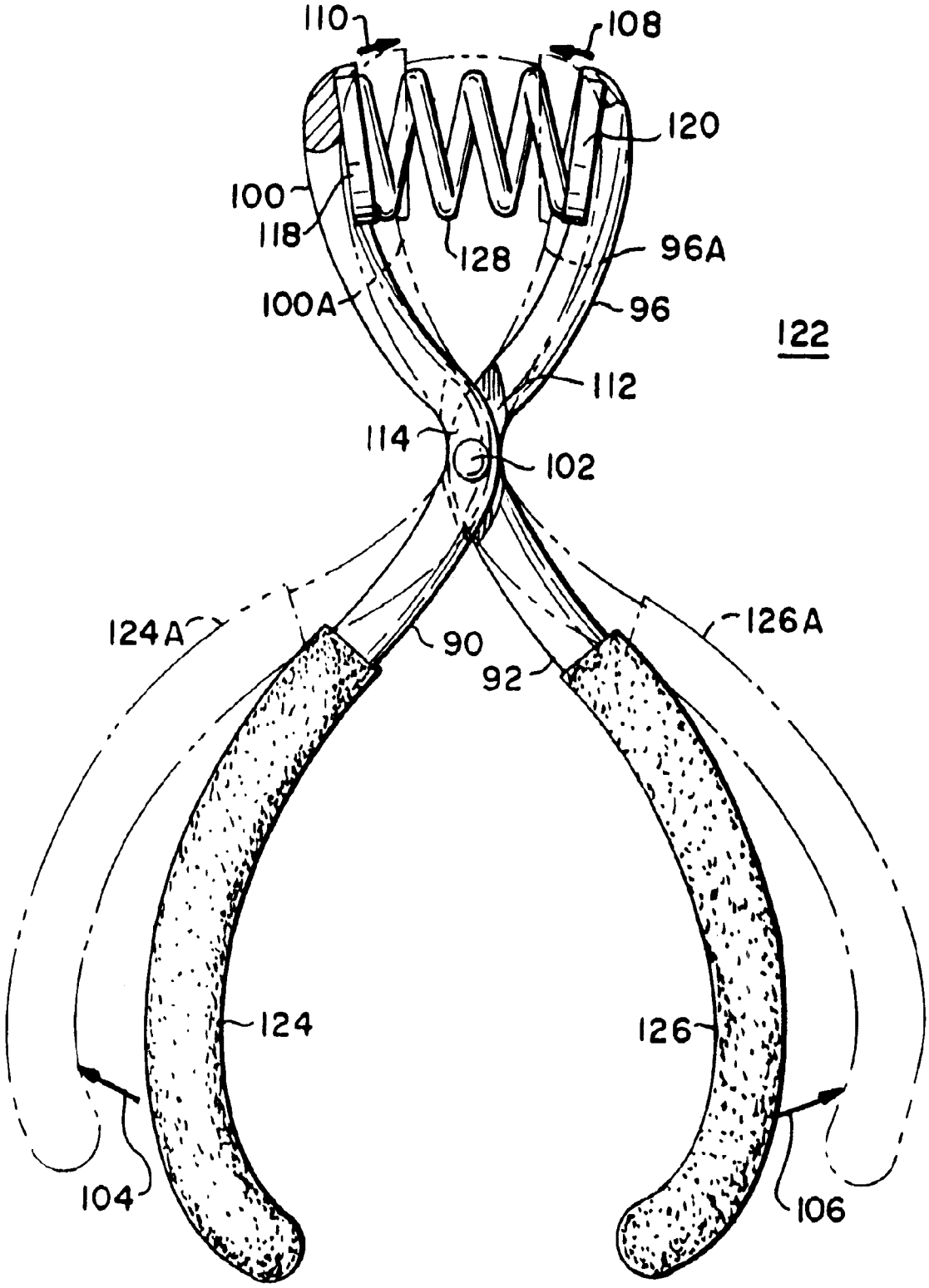
FIG. 17 is a perspective view similar to the embodiment of FIG. 16 but carrying a padded foam jacket on one of its ends of its thigh contacting clamp members and having a compression spring spanning between its other end of its thigh contacting clamp members.

Referring now to FIGS. 16–18 of the drawings, which illustrate other embodiments of exercising devices of the present invention that differ from those earlier described primarily in that the thigh engaging clamp members of FIGS. 16–18 are biased in a closed condition and retarded from obtaining their opened position, by selectable resilient members affixed at one end of the thigh engaging clamp members. A specific embodiment of these additional embodiments may be described with reference to FIG. 16 that illustrates an exercising device 88 having a shape somewhat like a pair of pliers.

Exercising device 88 comprises first and second hook shaped thigh engaging clamp members 90 and 92, respectively. The first clamp member 90 has first and second ends 94 and 96 respectively, whereas the second clamp member 92 has first and second ends 98 and 100 respectively. The exercising device 88 has means 102 for supporting the first and second clamp members 90 and 92 for lying and swinging in parallel planes about an axis perpendicular to the planes in a manner similar to that described with reference to FIGS. 1–6. The direction of movement of the first and second clamp members 90 and 92 is indicated by directional arrows 104, 106, 108 and 110. The first and second clamp members 90 and 92 move, relative to the plane between a closed condition (indicated by the solid portions 94, 96, 98 and 100) and an open condition (indicated by the phantom portions 94A, 96A, 98A and 100A). The means 102 is preferably a pin having a diameter selected to be inserted into diametrically aligned openings (not shown) in the first and second clamp members 90 and 92. Preferably the clamp members 90 and 92 have complementary tapered portions 112 and 114 located in the general region of the pin 102 to thereby allow the first and second clamp members 90 and 92 to more readily move pass each other, when swinging or pivoting about pin 102.

The exercising device 88 further comprises biasing or compressable means 116 rigidly affixed within cups 118 and 120 which are attached to the second end 96 and 100 of the first and second clamp members 90 and 92 respectively. Means 116 may have a cylindirical form and be comprised of a resilient sponge-like or elastimeric material. The means 116 is dimensioned to have a length so as to span between the second ends 96 and 100 of the first and second clamp members 90 and 92 respectively and to have a resilient compressible characteristic so as to exert an outward force (as viewed in FIG. 16) on each of the second ends 96 and 100 as the corresponding first ends 94 and 98 of the first and second clamp members 90 and 92 are urged outwardly. Compressible means 116 can be removably detached to cups 118 and 120 so as to change the density and compressibility so as to allow for different degrees of expansion of arms 94 and 98.

A further exercising device 122 having many of the features of exercising device 88, as indicated by identical reference numbers therebetween, may be further described with reference to FIG. 17.

The exercising device 122 of FIG. 17 is different from the exercising device 88 of FIG. 16, in that it includes soft elastomeric compressible sheaths 124 and 126 respectively covering at least a portion of the first ends 94 and 98 (not shown in FIG. 17) of the first and second clamp members 90 and 92 respectively. Further, the exercising device 122 utilizes a compressible spring 128, rather than the resilient member 116 of the device 88 of FIG. 16.

The compressible spring 128 is dimensioned so as to have an overall length to span between the second ends 96 and 100 of the first and second clamp members 90 and 92, respectively, and a spring constant characteristic so as to exalt an outward force (as viewed in FIG. 17) on each of the second ends 96 and 100 so that the first ends 94 and 98 (not shown) of the first and second clamp members 92 and 94 are biased to their contracted or closed condition. Further, the spring constant of the compression spring 128 is selected so as to exert reactive forces on the second ends 96 and 100 as the first ends 94 and 98 of the clamp members 90 and 92 move outward as indicated in FIG. 17 by directional arrows 104 and 106. The outward movement of the first ends 94 and 98 of clamp members 90 and 92 creates a compression force on compression spring 128. The spring constant of compression spring 128 is also selected to provide a restoring force, after the removal of the compression force created by the movement of clamp members 90 and 92, so that the first ends 94 and 98 of the first and second clamp members 90 and 92 are restored to their contracted condition. A further exercising device 130 having many of the same features of exercising devices 122 and 88, as indicated by the same reference numbers therebetween, may be further described with reference to FIG. 18.

The exercising device 130 differs from exercising devices 88 and 122 in that its first and second clamp members 90 and 92 have complementary tapered portions 132 and 134, respectively, located in the general region of the pin 102. The tapered portions 132 and 134 have a shape different from that of the tapered portions 112 and 114 of exercising devices 88 and 122, but accomplish the same function in allowing the first and second clamp members 90 and 92 to more readily move pass each other when the first and second clamp members 90 and 92 are swinging or pivoting about pin 102. Further, the second ends 96 and 100 of the first and second clamp members 90 and 92, respectively, preferably have openings 136 and 138 respectively that accommodate a biasing means 140 of FIG. 18 comprised of an elastomeric cord having similar characteristics to elastomeric cord 66 previously described with reference to FIG. 9.

The elastomeric cord 140 has opposite ends 142 and 144 that are respectively inserted through openings 136 and 138. The end 142 has a knot 146 therein that prevents the passage of the end 142 through opening 136, whereas the end 144 has a knot 148 therein that prevents the passage of the end 144 through opening 138. The elastomeric cord 140 is dimensioned so as to have a length that somewhat snugly spans between the second ends 96 and 100 of first and second clamp members 90 and 92 respectively. Further, the elastomeric cord 140 is dimensioned to have a characteristic which provides an inwardly directed (as viewed in FIG. 18) force on each of the ends 96 and 100 so as to offer a resistance to retard the first ends 94 and 98 of the first and second clamp members 90 and 92 from obtaining their open condition during the exercising routines by a user.

A further difference between the embodiment 130 of FIG. 18 and those embodiments of FIGS. 16 and 17, is that when the first and second clamp members 90 and 92 of the embodiment 130 seek their open condition, the second end portions 96 and 100, as indicated by their phantom representations of 96A and 100A respectively, move in directions 150 and 152, respectively, which are opposite to the corresponding directions 108 and 110 of FIGS. 16 and 17. The opposite directions 150 and 152 of movement are created because the second ends 96 and 100 are allowed to be separated from each other, until the elastomeric cord 140 provides a force that retards such separation. The elastomeric cord 140 also provides a force to restore the second ends 96 and 100 from the location of their phantom representations (96A and 100A) to the location of their solid representations (96 and 100), when the outward force created during exercising by a user is removed from the first ends 94 and 98 of the first and second thigh engaging clamp members 90 and 92.

A soft cover, not shown, may be used to cover the compressible means 116 of FIG. 16 or the springs 128 and cord 140 of FIGS. 17 and 18 respectively.

The application and operation of the exercise devices 130 of FIG. 18, exercising device 122 of FIG. 17, and exercising device 88 of FIG. 16 are similar to that of the exercising devices earlier explained with reference to FIGS. 1–8.

More particularly, elastomeric member 116 of exercise device 88 provides a resistance force to retard the movement of the first and second clamp members 90 and 92 from their contracted to their opened conditions. This resistance force is created when the exercising device 88 is used to exercise the thighs and buttocks of a person in a manner already described with reference to FIGS. 1–8. Similarly, the compression spring 128 of the exercising device 122 creates a resistance to act against the first and second clamp members 90 and 92 from being moved from their contracted condition to their open condition. Such movement occurs during exercising allowing the person to gain the benefits of the present invention.

Similarly, the elastomeric cord 140 of the device 130 provides the resistance force to act against the movement of the first and second clamp members 90 and 92 from their contracted condition to their open condition.

Figure 19:
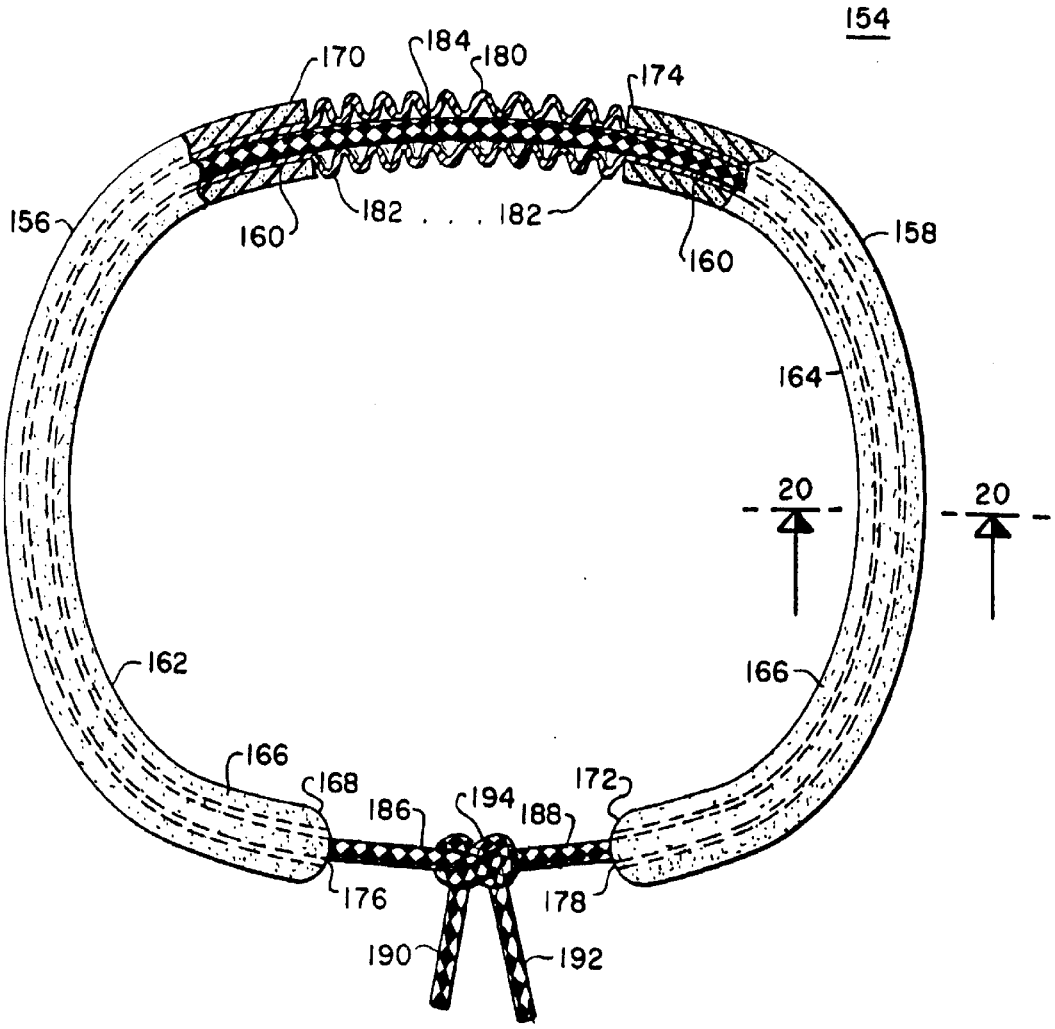
FIG. 19 is a perspective view of still yet another embodiment of an exercising device of the present invention that employs both an elastomeric cord and a flexible-compressible tubular member.

Another exercising device 154 of the present invention may be described with reference to FIG. 19 shown partially in section. The exercising device 154 comprises first and second thigh engaging clamp members 156 and 158. The clamp members 156 and 158 comprise a tubular self-supporting member 160 covered by sheath portions 162 and 164 each comprising an elastomeric compressible material 166. Elastomeric compressible sheath members 162 and 164 defines diametrically opposed portions, wherein one opposite portion 162 has first and second ends 168 and 170, respectively, and the other opposite portion 164 has first and second ends 172 and 174, respectively. The first end 168 of opposite portion 162 corresponds to a first end 176 of the tubular member 160, whereas the first end 172 of opposite portion 164 corresponds to a second end 178 of the tubular member 160.

While the shape of clamp members 156 and 158 are more curved than the clamp members of the embodiments shown in FIGS. 1–18, clamp members 156 and 158 may be shared similar to that shown in FIGS. 1–18 with the flexible rear section such as the bellows portion replacing the pivot.

The tubular member 160 has a flexible portion 180 comprised of bellows 182 that expand and contract in response to the presence and then absence of a stretching force. The flexible portion 180 is selected to have a length which spans between the second ends 170 and 174 of the diametrically opposed portions 162 and 164, respectively.

The exercising device 154 further comprises a elastomeric cord 184 dimensioned so as to have a length that completely occupies the tubular member 160 and also that includes end portions 186 and 188 that exit from and that span between the firs. And second ends 176 and 178 of the tubular member. The end portions 186 and 188 of the elastomeric cord 184 also have ends 190 and 192 that are releasably joined by any convenient closure means such as a knot 194 or loop shaped coupling member illustrated in FIG. 9, as shown in FIG. 19. The arrangement of the elastomeric cord 184 may be further described with reference to FIG. 20, which is a cross-sectional view taken along line 20—20 of FIG. 19.

Figure 20:
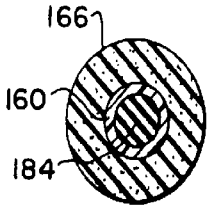
FIG. 20 is a sectional view taken along line 20—20 of FIG. 19.

As seen in FIG. 20, the elastomeric cord 184 is housed within the tubular member 160 which, in turn, carries the elastomeric compressible material 166.

In operation, the flexible portion 180, comprised of the bellows 182 acts in a manner similar to a door return spring. More particularly, the flexible portion 180 of the tubular member 160 becomes stretched as the thigh engaging clamp members 156 and 158 are moved apart from each other by the movement of the thighs, occurring during exercising, but after the stretching no longer exists as also occurring during the exercising routine, the flexible portion 180 begins to contract, in a manner similar to a door return spring, so that the exercising device 154 is returned to its non-expanded shape, shown in FIG. 19.

It should now be appreciated that the practice of the present invention provides various embodiments of exercising device all of which may be advantageously used for the exercise of the thighs and buttocks of a person. Further, the principles of the present invention also apply to the exercising of other portions of the body of a person. Furthermore, it should be recognized that each of the devices hereinbefore described is of a nature that is characterized by its ruggedness, simplicity in construction and its use, its low cost, and its convenience and effectiveness, while also having high versatility and adaptability.

While there been described and illustrated preferred embodiments of the present invention, it is apparent that numerous alterations, omissions, and additions may be made without departing from the spirit thereof.

What we claim is:

1. An exercising device comprising first and second hook shaped thigh engaging clamp members each having first and second ends, means supporting said first and second clamp members for lying and swinging in parallel planes about an axis perpendicular to said planes for relative movement between a closed contracted condition and an open extended condition, said parallel planes being mutually axially spaced, said clamp members having opposite confronting inside concave faces and means biasing said first end of each of said first and second clamp members to said contracted condition, each of said first and second clamp members having an axial bore, said supporting means comprising a cylindrical body, said biasing means comprising an elastomeric cord having outer end sections traversing each of said axial bores of said first and second clamp members and extending around said cylindrical body and beyond said first ends of said first and second clamp members and retaining means releasably interconnecting said cord outer end sections.

2. The exercising device according to claim 1 wherein said first and second clamp members are tubular.

3. The exercising device according to claim 1 including elastomeric compressible sheaths covering at least a portion of each of said first and second clamp members.

4. The exercise device according to claim 1 wherein said cylindrical body comprises a hinge member rotatably coupling said second ends of said first and second clamp members and having an axial cylindrical section defining a peripheral guide groove for said elastomeric cord to traverse around said cylindrical body.

5. The exercising device according to claim 4 wherein said hinge member comprises a pair of axially spaced integrally joined outer circular discs and an inner disc rotatably sandwiched and joined between said pair of outer circular discs defining said peripheral guide groove.

6. The exercising device according to claim 1 wherein said axial bore of each of said first and second clamp members has a plastic lining.

7. The exercising device according to claim 1 wherein said retaining means comprises a loop shaped coupling member having a longitudinal extending opening with longitudinally converging confronting end faces delineating wedge shaped slots wherein said cord outer end sections are releasably retained.

8. The exercising device according to claim 1 wherein said first and second clamp members are made of metal.

9. The exercising device according to claim 1 wherein said first and second clamp members are made of hard rigid plastics.

* * * * *